United States Patent [19]

Ustin

[11] 4,269,470

[45] May 26, 1981

[54] MODULAR ELECTRICAL TERMINAL BOARD

[76] Inventor: Martin D. Ustin, 382 Central Park West, New York, N.Y. 10025

[21] Appl. No.: 67,296

[22] Filed: Aug. 17, 1979

[51] Int. Cl.[3] ..... H01R 9/16

[52] U.S. Cl. ..... 339/198 H; 339/198 G

[58] Field of Search ..... 339/113 B, 198 G, 198 GA, 339/198 A

[56] References Cited

U.S. PATENT DOCUMENTS

| | | | |
|---|---|---|---|
| Re. 25,446 | 9/1963 | Ustin | 339/198 G |
| 2,743,373 | 4/1956 | Desmidt | 339/198 G |
| 2,922,139 | 1/1960 | Ustin | 339/198 G |
| 3,019,408 | 1/1962 | Ustin | 339/198 G |
| 3,201,747 | 8/1965 | Blanchet | 339/198 GA |
| 3,212,051 | 10/1965 | Clewes | 339/198 G |
| 3,245,029 | 4/1966 | Piperato | 339/198 GA |
| 3,824,553 | 7/1974 | Glover | 339/198 GA |
| 4,180,305 | 12/1979 | Ustin et al. | 339/198 H |

*Primary Examiner*—Eugene F. Desmond

*Attorney, Agent, or Firm*—Spellman, Joel & Pelton

[57] ABSTRACT

An electrical terminal board comprises a plurality of modules having contacts which clamp the individual modules to adjacent modules as well as position them with respect to one another. The modules are secured together preferably by a dovetail arrangement wherein a dovetail slot on each side of the contacts mates with a corresponding protrusion on the individual molded plastic modules. Each module comprises a base having a wall extending upwardly from one surface thereof at substantially the mid-point of the base with the wall having dovetail protrusions extending outwardly on each side thereof at an intermediate point. The contacts may include a variety of configurations such as a tubular or flat structure having a mating dovetail protrusion on the module wall securing the adjacent modules together. The module spacing may be varied merely by employing contacts of different widths. The modules, as grouped together by the fastening and clamping contacts, do not require channels to form a terminal board and do not require specifically designed end sections.

7 Claims, 10 Drawing Figures

MODULAR ELECTRICAL TERMINAL BOARD

BACKGROUND OF THE INVENTION

This invention relates to electrical terminal boards and particularly to modular terminal boards made up of interlocking sections.

Terminal blocks or boards are currently available in a variety of sizes and are used in applications ranging from low to utility voltages. Such boards may be either one-piece, sectional or modular construction and are also available in a single or double row construction.

A variety of top (above the board) and bottom (below the board) hardware is available to accommodate specific wiring conditions and installations. For example, contacts are available with screws for attaching wire lug assemblies, contacts are available with screws to clamp a bare conductor, and contacts are available in a rectangular tubular form wherein the conductors are retained either by a direct screw connection or a clamp connection. Contacts may also include "fast-on" terminals for quick connections or the contacts can "feed-through" a block, and the feed through unit may have solder tabs, fast-on tabs or even screw tabs. Others have open spaces between the barriers for ease of installation but may require covers. Most blocks utilize marking strips for circuit identification purposes.

Terminal boards or blocks are generally either of a one-piece or sectional construction. The one-piece units are usually molded in long lengths and cut to a specified circuit length. In some cases, they are molded to a specific length. Spacing between circuits is fixed as is electrical rating. In the sectional construction, units are assembled in multiples to suit a customer's requirements. Most sectional blocks require end mounts to complete the structure. This construction usually requires channel mounting for additional strength and support. Electrical hardware in both constructions can be quite varied, but the spacings between circuits are fixed requiring different moldings to accommodate different ratings.

The present invention proposes a modular unit which utilizes the same molding throughout a predetermined range but permits varying the spacing and therefore the electrical rating according to need. With a range of spacings, the user can accommodate his power wiring, control wiring and signal wiring. The terminal board as described hereinafter includes contacts which clamp the section modules together and which do not require an end section or retainer channel. The prior art is represented by U.S. Pat. No. 3,824,553 to Glover et al which discloses modular connectors mounted on a track and including matching tab portions and indents for interlocking the modules. A channel is located along the side of the modules for receiving and retaining a marker strip which acts to tie the modules together as well as operating as an identification strip. In contrast, the contact strip of the present invention serves to connect paired modules, is a connector and contact strip in combination oriented along a different axis.

Other prior art of general interest include U.S. Pat. Nos. 2,922,139, 3,019,408 and U.S. Pat. No. Re. 25,446 to G. Ustin as well as U.S. Pat. Nos. 3,201,747 to L. Blanchet, 3,121,051 to A. B. Clewes and 3,245,029 to J. Piperato.

SUMMARY OF THE INVENTION

The present invention relates to electrical terminal boards of a modular construction having contacts which clamp the individual modules together. The contacts include side portions having a slot which may be of a dovetailed configuration and formed by outwardly extending protrusions. The contacts may include a variety of configurations such as a tubular or flat structure or may include studs or fast-on connections extending therethrough. The molded modules each comprise a base having a wall extended upwardly from one surface thereof at substantially the mid-point of the base with the wall having mating protrusions of a dovetail or other suitable shape extending outwardly on each side thereof at an intermediate point. The mating protrusions engage the slots on the contacts to secure and clamp adjacent modules together.

Accordingly, an object of this invention is to provide a new and improved electrical terminal board of a modular construction.

Another object of this invention is to provide a new and improved modular terminal board wherein the contacts clamp the modules together and position them with respect to one another.

A further object of this invention is to provide a modular terminal board wherein the contacts may be used to program a common molding to provide a grouping of contact spacings for particular needs.

A more specific object of this invention is to provide a new and improved terminal board of a modular construction wherein the contacts secure adjacent modules together at predetermined spacings without the use of a module retaining element.

BRIEF DESCRIPTION OF THE DRAWINGS

Other objects and advantages may be seen from the following description when viewed in conjunction with the accompanying drawings wherein.

DETAILED DESCRIPTION OF THE INVENTION

Figure 1:
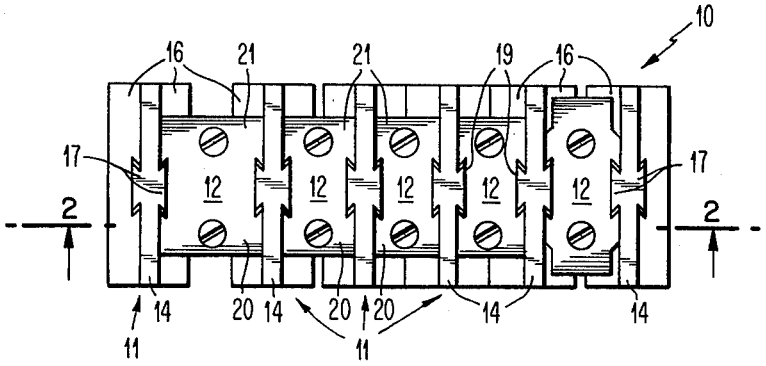
FIG. 1 is a plan view of the terminal board incorporating the present invention.
Figure 2:
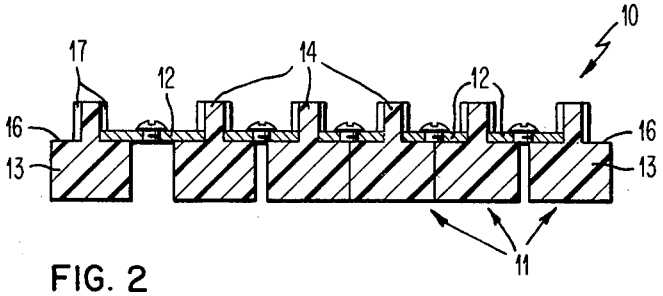
FIG. 2 is a cross-sectional view along the lines 2—2 of FIG. 1, FIGS. 3 and 4 are an alternate embodiment of the invention showing a tubular construction of the contact portion of the invention, and, FIGS. 5*a*, 5*b*, 6*a*, 6*b* and 7*a*, 7*b* illustrate alternate embodiments of the invention showing plan and side views, respectively, for each embodiment.

Referring to FIGS. 1 and 2 of the drawings, the invention comprises a terminal board 10 consisting of a plurality of separate modules 11 joined by contacts 12. The modules 11 each comprise a plastic molding with a base 13 and an upwardly extending wall 14 along the upper surface 16 at substantially the mid-point thereof. The wall 14 includes outwardly extending protrusions 17 which themselves taper outwardly towards the base 16.

In one preferred embodiment the contacts comprise a substantially flat metal element 12 having outwardly extending projections 18 which form a dovetail slot 19 therebetween. Slot 19 is engaged by the protrusions 17 to clamp and position the individual module sections together without the use of a guide strip or end sections.

Terminal blocks are categorized by UL, CSA, and NEMA and other certifying agencies, by voltage and amperage or wire size capacities. Ratings are essentially a function of creepage and clearance or center-to-center contact spacing. Industry has standardized on center-to-center spacings of $\frac{1}{4}$, $\frac{3}{8}$, 7/16, 9/16, 11/16, $\frac{7}{8}$ and $1\frac{1}{8}$ inch spacings. This entails the construction of separate moldings to accommodate the particular contacts to obtain the desired rating. With the contacts 12 it is possible to program the width or spacing between modules by merely varying the width of the contact 12 while retaining the same size modules 11. Generally, the contact widths would be grouped in adjacent size categories.

To secure the contacts 12 more firmly in position, it is possible to bend down the end portions 20 and 21 on each contact preferably at right angles to the main body portion thereof and provide apertures (not shown) in the plastic or insulating modules 12. The bent over end portions 20 and 21 would then fit into the apertures.

Figure 3:
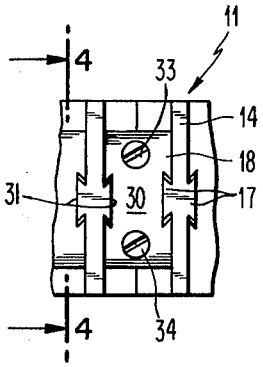
Figure 4:
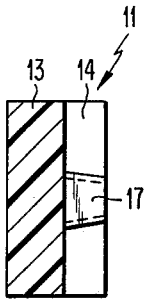
Figure 5A:
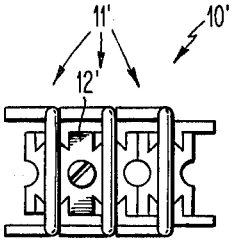
Figure 6A:
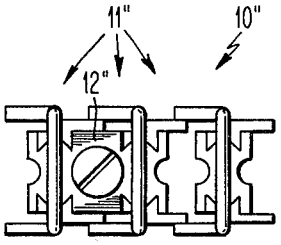
Figure 5B:
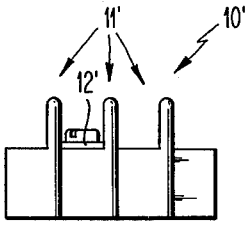
Figure 6B:
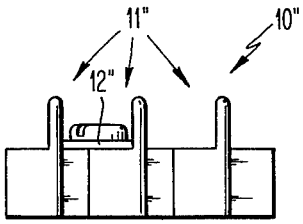

An alternate embodiment is shown in FIG. 3 wherein a tubular contact element 30 is provided. The tubular contact 30 includes dovetail slots 31 on the side portions thereof which are engaged by the dovetail protrusions 17 of the modules 11. Screw apertures 33 are provided in the upper and lower surfaces of the contact element 30 so that screw type connectors 34 may be utilized to connect wires to the contact element 30 so that screw type connectors 34 may be utilized to connect wires to the contact element 30. While not shown, the screws 34 may extend completely through the modules 11 in order to secure the terminal board 10 to a chassis.

The contacts 12 shown in FIG. 2 are merely illustrative of the principles of the invention and numerous variations may be made without varying from the scope of the invention. For example, it is possible to utilize screw connectors which extend through the contacts 12 into the molding 11 or completely therethrough to the chassis (not shown). Alternatively, "fast-on" connections of various types may be utilized in conjunction with the present invention. The principle of utilizing contacts which clamp modular sections together in a programmed arrangement may be illustrated in many different embodiments and it is only intended to show illustrative embodiments herein.

Figure 7A:
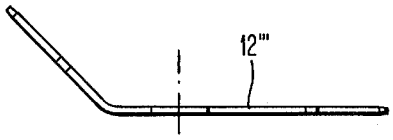
Figure 7B:
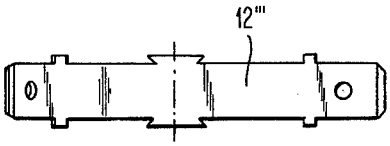

FIGS. 5*a*, 5*b* and 6*a*, 6*b* for example, illustrate further embodiments of the invention employing modules of different widths. FIGS. 7*a* and 7*b* illustrate an elongated contact strip 12 which is bent downwardly at one end thereof. Also, while the invention has mainly been illustrated with mating dovetail portions, protrusions of many different configurations may be used in conjunction with mating slots and still not depart from the spirit nor scope of the invention.

I claim:

1. An electrical terminal board comprising:

a plurality of modules made of an insulating material, each module comprising a base portion, a wall extending upwardly from one side of the base at substantially the mid-point thereof, said wall including dovetail protrusions extending outwardly on each side thereof, and, a contact between each module having a dovetail slot on each side thereof to engage the dovetail protrusions on the opposite walls of adjacent modules thereby clamping and positioning said modules together.

2. An electrical terminal board in accordance with claim 1 wherein:

the outward protrusions on the walls are located at substantially the mid-point thereof and wherein said dovetail protrusions taper outwardly towards the module base to fixedly secure said contacts in place.

3. An electrical terminal board in accordance with claim 2 wherein:

the base of the modules is substantially rectangular in configuration and the modules comprise a molded plastic material.

4. An electrical terminal board in accordance with claim 2 wherein:

the module includes at least one aperture in said base, and, the contact comprises a flat metal strip and includes at least one aperture extending through said strip opposite the module aperture to permit terminal mounting.

5. An electrical terminal board in accordance with claim 1 wherein:

the contacts comprise a flat metal strip having outward protrusions on opposite sides thereof which form a dovetail slot for engagement with the protrusions of the module walls.

6. An electrical terminal board in accordance with claim 5 wherein:

the ends of the contact strip are bent at right angles to the surface thereof and wherein the base of the modules includes apertures which are engaged by the bent end portions to secure said contacts in place.

7. An electrical terminal board in accordance with claim 1 wherein:

the contact comprises a tubular member having apertures therethrough for the mounting of terminal screws.

* * * * *